US008734135B2

(12) United States Patent
Tsai

(10) Patent No.: US 8,734,135 B2
(45) Date of Patent: May 27, 2014

(54) ELECTRIC AIR PUMP WITH A HINGED CONNECTION BETWEEN THE CASING AND OUTER BRACKET

(75) Inventor: Jing-Hong Tsai, Dongguan (CN)

(73) Assignee: Zhe Jiang Hong Zhu Plastic Hardware Co., Ltd. (CN)

( * ) Notice: Subject to any disclaimer, the term of this patent is extended or adjusted under 35 U.S.C. 154(b) by 274 days.

(21) Appl. No.: 13/398,384

(22) Filed: Feb. 16, 2012

(65) Prior Publication Data

US 2013/0052050 A1 Feb. 28, 2013

(30) Foreign Application Priority Data

Aug. 30, 2011 (CN) ..... 2011 2 0129211 U
Sep. 6, 2011 (CN) ..... 2011 2 0345474 U

(51) Int. Cl.

| | |
|---|---|
| ***F04B 35/04*** | (2006.01) |
| ***A47C 27/08*** | (2006.01) |
| ***F04D 29/42*** | (2006.01) |
| ***F04D 29/40*** | (2006.01) |
| ***F04D 29/60*** | (2006.01) |

(52) U.S. Cl.

CPC ..... *F04D 29/4226* (2013.01); *F04D 29/403* (2013.01); *F04D 29/601* (2013.01)

USPC ..... 417/423.15; 417/423.14; 5/713

(58) Field of Classification Search

CPC ... F04D 23/00; F04D 29/403; F04D 29/4226; F04D 29/601; F04B 35/04; A47C 27/08

USPC ..... 417/360, 423.14; 5/706, 713

See application file for complete search history.

(56) References Cited

U.S. PATENT DOCUMENTS

| | | | |
|---|---|---|---|
| 6,679,686 | B2 | 1/2004 | Wang |
| 7,039,972 | B2 | 5/2006 | Chaffee |
| 7,922,461 | B2 | 4/2011 | Wang |
| 2011/0083753 | A1 | 4/2011 | Chaffee |
| 2011/0180169 | A1 | 7/2011 | Song et al. |

FOREIGN PATENT DOCUMENTS

| | | |
|---|---|---|
| DE | 20310131 | 2/2003 |

*Primary Examiner* — Devon Kramer
*Assistant Examiner* — Christopher Brunjes
(74) *Attorney, Agent, or Firm* — William E. Pelton, Esq.; Cooper & Dunham LLP

(57) ABSTRACT

An electric air pump has a pumping assembly, an outer bracket and an inlet plate. The pumping assembly has a casing. The outer bracket is connected pivotally to the pumping assembly and has a faceplate mounted pivotally on an open top of the casing of the pumping assembly and selectively hermetically contacting a top annular edge of an open top of the casing. A locking hole is defined through the faceplate. The inlet plate is mounted securely in the casing, located between the casing and the outer bracket and has a resilient locking hook selectively hooking in the locking hole of the outer bracket. The electric air pump is capable of inflating and deflating an inflatable product without cooperating with external devices.

8 Claims, 8 Drawing Sheets

ELECTRIC AIR PUMP WITH A HINGED CONNECTION BETWEEN THE CASING AND OUTER BRACKET

BACKGROUND OF THE INVENTION

1. Field of the Invention

The present invention relates to a pump, and more particularly to an electric air pump that is capable of inflating inflatable products and deflating the inflatable products.

2. Description of Related Art

Inflatable products such as water sofas or inflatable mattresses require sufficient air quantity to achieve the best effect. However, such products are frequently under the circumstances of over inflation or insufficient inflation. For example, improper inflating control causes an inflatable product to include excessive air. Therefore, surplus air needs to be released from the inflatable product. After inflation, an outer covering of the inflatable product elongates due to several factors such as temperature variation or high pressure of the inside air, which results in insufficiency of pressure of the inflatable product. Therefore, additional air needs to be supplied into the inflatable product.

Conventional marketable inflatable products employ separate electric air pump and air discharge valve to implement inflation and deflation timely. However, operating the aforementioned two separate components is inconvenient. Furthermore, the inflatable product with the separate components is complicated in fabrication and therefore has high cost.

To overcome the shortcomings, the present invention provides an electric air pump to mitigate or obviate the aforementioned problems.

SUMMARY OF THE INVENTION

The main objective of the invention is to provide an electric air pump that is capable of inflating inflatable products and deflating the inflatable products.

An electric air pump in accordance with the present invention has a pumping assembly, an outer bracket and an inlet plate. The pumping assembly has a casing. The outer bracket is connected pivotally to the pumping assembly and has a faceplate mounted pivotally on an open top of the casing of the pumping assembly and selectively hermetically contacting a top annular edge of an open top of the casing. A locking hole is defined through the faceplate. The inlet plate is mounted securely in the casing, located between the casing and the outer bracket and has a resilient locking hook selectively hooking in the locking hole of the outer bracket. The electric air pump is capable of inflating and deflating an inflatable product without cooperating with external devices.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
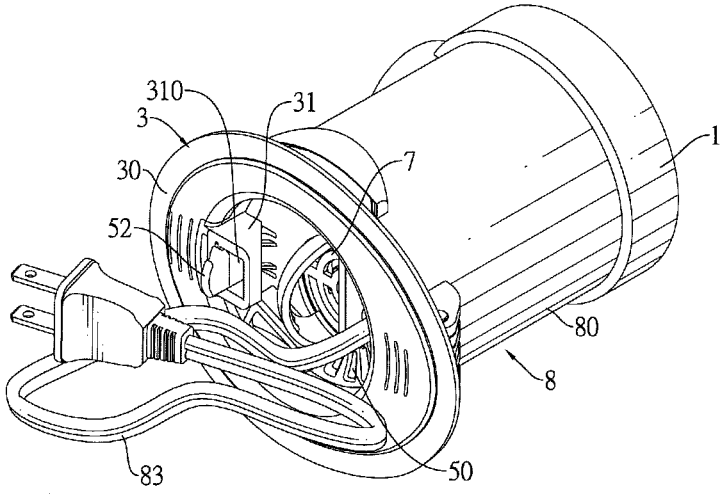
FIG. 1 is a perspective view of an electric air pump in accordance with the present invention.
Figure 2:
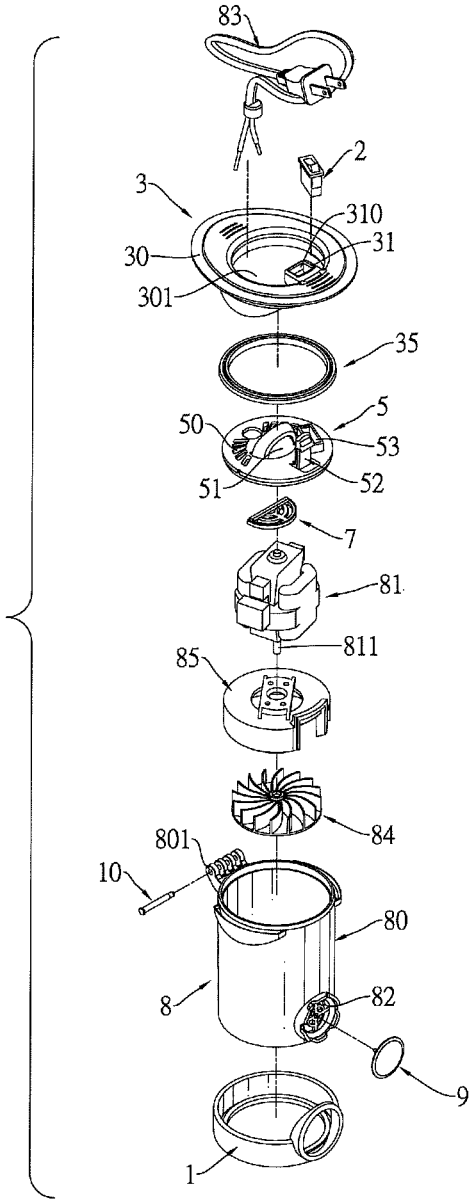
FIG. 2 is an exploded perspective view of the electric air pump in FIG. 1.
Figure 3:
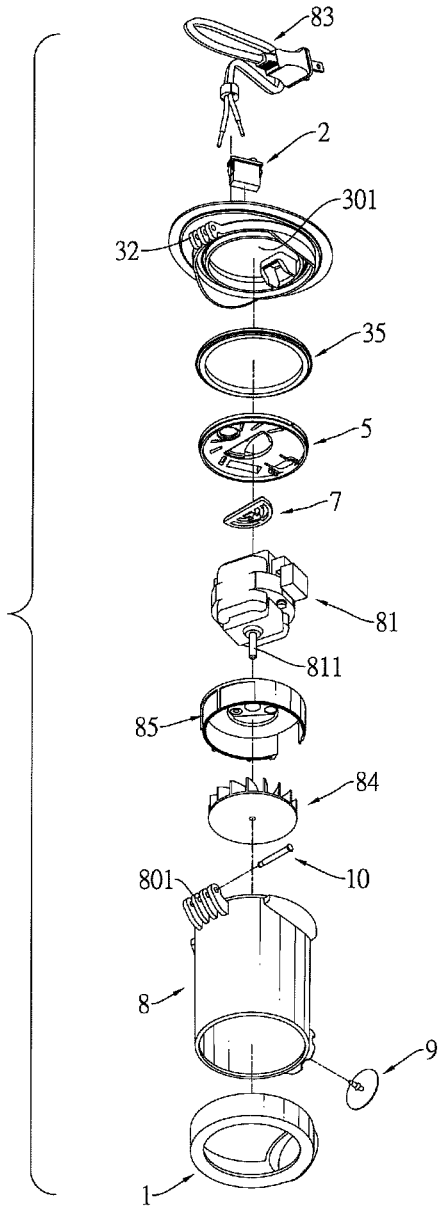
FIG. 3 is another exploded perspective view of the electric air pump in FIG. 1.

With reference to FIGS. 1 to 3, a first embodiment of an electric air pump in accordance with the present invention is mounted on an outer covering 11 of an inflatable product such as an inflatable mattress and comprises a pumping assembly 8, an outer bracket 3 and an inlet plate 5 and may further have a power switch 2.

The pumping assembly 8 has a casing 80, a motor 81, a fan 84, a power cable 83 and an air guide 85.

The casing 80 is cylindrical and has an open top, a bottom, an outer surface and a cavity and may further have an inflating opening 82, a pivot member 801 and a check valve diaphragm 9. The open top has a top annular edge. The cavity is defined in the casing 80 and communicates with the open top. The inflating opening 82 is defined through the outer surface of the casing 80 near the bottom and communicates with the cavity. The pivot member 801 is formed on the outer surface of the casing 80. The check valve diaphragm 9 is mounted movably in the inflating opening 82 to prevent air in the inflatable product from flowing in the cavity through the inflating opening 82.

The motor 81 is mounted in the cavity of the casing 80 and has a shaft 811 rotatably mounted on the motor 81.

The fan 84 may be a centrifugal fan and is mounted on the shaft 811.

The power cable 83 is connected to the motor 81.

The air guide 85 is mounted rotatably around the shaft 811 of the motor 81 and covers the fan 84.

Figure 4:
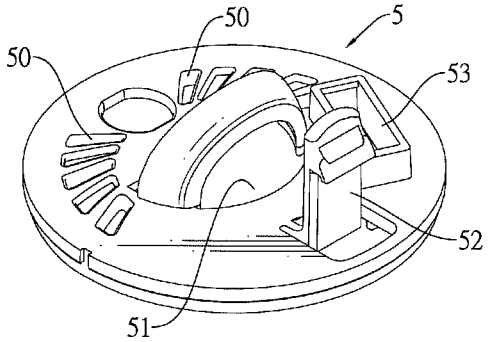
FIG. 4 is a perspective view of an inlet plate of the electric air pump in FIG. 1.

With further reference to FIG. 4, the outer bracket 3 is annular, is connected pivotally to the pumping assembly 8 and has a faceplate 30, an opening 301 and a locking member 31 and may further have a pivot element 32.

The faceplate 30 is mounted pivotally on the open top of the casing 80 of the pumping assembly 8, selectively hermetically contacts the top annular edge of the open top of the casing 80 and may be mounted on the outer covering of the inflatable product. The faceplate 30 may have a bottom surface, an annular mounting groove 303 and a resilient seal ring 35. The annular mounting groove 303 is defined in the bottom surface. The resilient sealing ring 35 is made of resilient material such as plastic or rubber, is mounted in the annular mounting groove 303 and selectively hermetically contacts the top annular edge of the open top of the casing 80.

The opening 301 is defined through the faceplate 30 and has an inner annular edge.

The locking member 31 is formed on the inner annular edge of the opening 301 and has a locking hole 310 defined through the locking member 31.

The pivot element 32 is formed on the faceplate 30 and is connected pivotally to the pivot member 801 of the casing 80 of the pumping assembly 8 through a pivot pin 10 that extends through the pivot element 32 and the pivot member 801.

The inlet plate 5 is mounted securely in the open top of the casing 80, is located between the casing 80 and the outer bracket 3 and has multiple inlet holes 50 and a resilient locking hook 52 and may further have a ventilation hole 51, a mounting recess 53 and an air grill 7.

The inlet holes 50 are defined through the inlet plate 5 and communicate with the cavity of the casing 80.

The resilient locking hook 52 is formed on and protrudes upward from the inlet plate 5 and selectively hooks in the locking hole 310 of the locking member 31 of the outer bracket 3.

Figure 5:
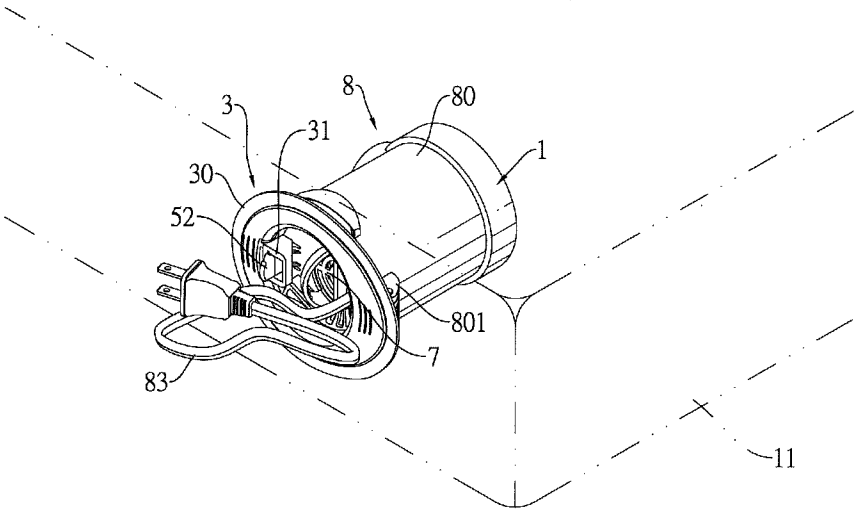
FIG. 5 is an operational perspective view of the electric air pump in FIG. 1 mounted on a body of an inflatable body of an inflatable product implementing inflation.
Figure 7:
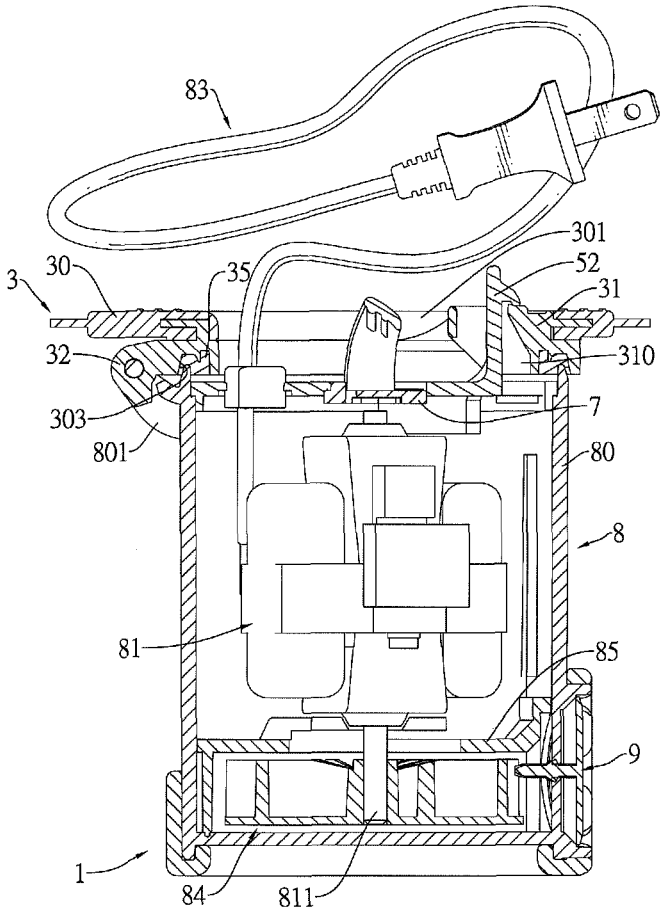
FIG. 7 is an operational cross sectional top view of the electric air pump in FIG. 5.

With further reference to FIGS. 5 and 7, when the resilient locking hook 52 hooks in the locking hole 310 of the locking member 31 of the outer bracket 3, the faceplate 30 hermetically contacts the top annular edge of the open top of the casing 80 to prevent air leakage and ensure the ambient air is pumped into the pumping assembly through the inlet holes 50.

Figure 6:
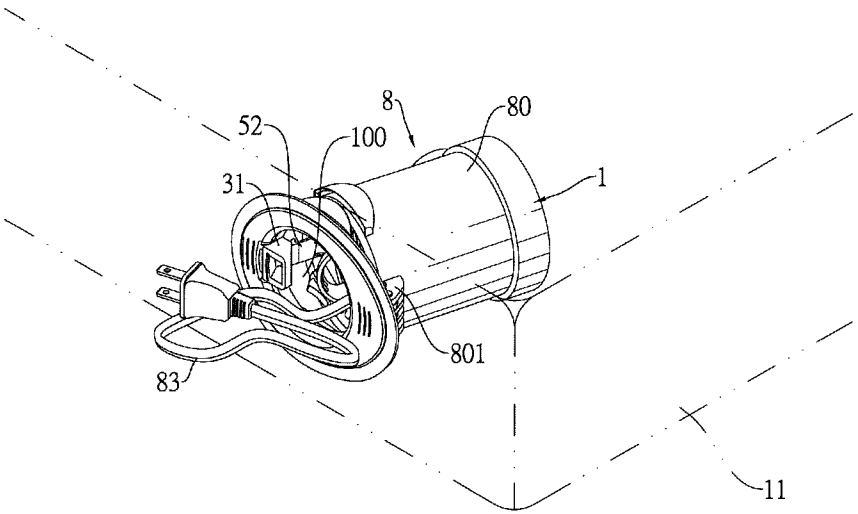
FIG. 6 is another operational perspective view of the electric air pump in FIG. 5 mounted on a body of an inflatable body of an inflatable product implementing deflation.
Figure 8:
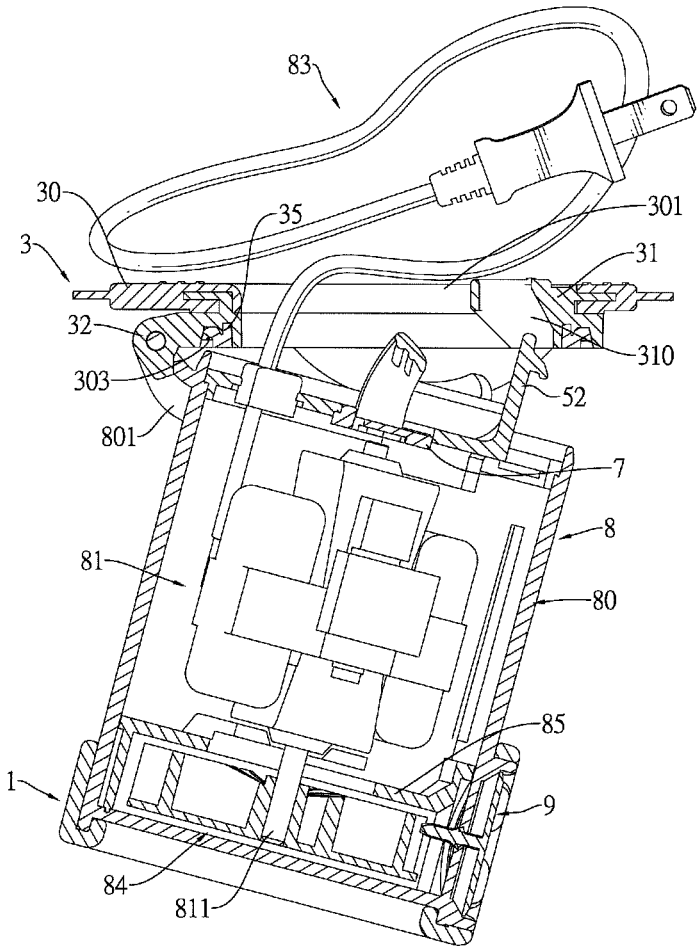
FIG. 8 is an operational cross sectional top view of the electric air pump in FIG. 7.

With further reference to FIGS. 6 and 8, when the resilient locking hook 52 is manually pulled and released from the locking hole 310 of the locking member 31 of the outer bracket 3, the outer bracket 3 pivots up relative to the casing 80 and the faceplate 30 separates from the top annular edge of the open top of the casing 80 to form an air exhaust gap 100 therebetween to allow air leakage from inside of the inflatable product to an ambient environment.

The ventilation hole 51 is defined through the inlet plate 5.

The mounting recess 53 is defined in the inlet plate 5.

The air grill 7 is mounted detachably in the ventilation hole 51 to prevent foreign objects such as dusts from inadvertently entering and damaging the pumping assembly 8.

The power switch 2 is mounted in the mounting recess 53 of the inlet plate 5 and is connected to the motor 81 such that pressing the power switch 2 turns on or off the motor 81.

With further reference to FIGS. 5 and 6, a second embodiment of the electric air pump further has a protective sleeve 1. The protective sleeve 1 is made of foam material and is mounted around the casing 80.

The electric air pump is capable of inflating and deflating an inflatable product without cooperating with external devices. Therefore, operating the electric air pump is convenient. The inflatable product with the electric air pump has a lower cost when compared to conventional products.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An electric air pump comprising:

a pumping assembly having a casing having an open top having a top annular edge;

a bottom;

an outer surface; and a cavity defined in the casing and communicating with the open top;

an outer bracket connected pivotally to the pumping assembly and having a faceplate mounted pivotally on the open top of the casing of the pumping assembly and selectively hermetically contacting the top annular edge of the open top of the casing;

an opening defined through the faceplate and having an inner annular edge; and a locking member formed on the inner annular edge of the opening and having a locking hole defined through the locking member; and an inlet plate mounted securely in the open top of the casing, located between the casing and the outer bracket and having multiple inlet holes defined through the inlet plate and communicating with the cavity of the casing; and a resilient locking hook formed on and protruding upward from the inlet plate and selectively hooking in the locking hole of the locking member of the outer bracket, wherein:

when the resilient locking hook hooks in the locking hole of the locking member of the outer bracket, the faceplate hermetically contacts the top annular edge of the open top of the casing; and when the resilient locking hook is pulled and released from the locking hole of the locking member of the outer bracket, the outer bracket pivots up relative to the casing and the faceplate separates from the top annular edge of the open top of the casing to form an air exhaust gap therebetween.

2. The electric air pump as claimed in claim 1, wherein the faceplate has a bottom surface;

an annular mounting groove defined in the bottom surface; and a resilient seal ring mounted in the annular mounting groove and selectively hermetically contacting the top annular edge of the open top of the casing.

3. The electric air pump as claimed in claim 2, wherein the casing further has an inflating opening defined through the outer surface of the casing near the bottom and communicating with the cavity; and a check valve diaphragm mounted movably in the inflating opening.

4. The electric air pump as claimed in claim 3, wherein the casing further has a pivot member formed on the outer surface of the casing; and the outer bracket further has a pivot element formed on the faceplate and connected pivotally to the pivot member of the casing of the pumping assembly through a pivot pin that extends through the pivot element and the pivot member.

5. The electric air pump as claimed in claim 1 further comprising a protective sleeve made of foam material and mounted around the casing.

6. The electric air pump as claimed in claim 2 further comprising a protective sleeve made of foam material and mounted around the casing.

7. The electric air pump as claimed in claim 3 further comprising a protective sleeve made of foam material and mounted around the casing.

8. The electric air pump as claimed in claim 4 further comprising a protective sleeve made of foam material and mounted around the casing.

* * * * *